US008100787B2

(12) United States Patent
Smith

(10) Patent No.: US 8,100,787 B2
(45) Date of Patent: Jan. 24, 2012

(54) BASEBALL BAT EMPLOYING A DUAL DENSITY FOAM MATERIAL

(75) Inventor: Chuck Smith, Gallatin, TN (US)

(73) Assignee: Mattingly Sports, Inc., Shelton, CT (US)

( * ) Notice: Subject to any disclaimer, the term of this patent is extended or adjusted under 35 U.S.C. 154(b) by 79 days.

(21) Appl. No.: 12/656,398

(22) Filed: Jan. 28, 2010

(65) Prior Publication Data

US 2011/0183788 A1 Jul. 28, 2011

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,727,295 | A * | 4/1973 | Gildemeister | 29/455.1 |
| 3,801,098 | A | 4/1974 | Gildemeister | |
| 4,014,542 | A * | 3/1977 | Tanikawa | 473/567 |
| 4,848,745 | A * | 7/1989 | Bohannan et al. | 473/119 |
| 5,458,330 | A | 10/1995 | Baum | |
| 5,511,777 | A * | 4/1996 | McNeely | 473/520 |
| 5,533,723 | A | 7/1996 | Baum | |
| 5,964,673 | A | 10/1999 | MacKay, Jr. | |
| 6,248,032 | B1 | 6/2001 | Filice et al. | |
| 6,334,824 | B1 * | 1/2002 | Filice et al. | 473/566 |
| 6,432,007 | B1 * | 8/2002 | Filice et al. | 473/566 |
| 7,294,073 | B1 | 11/2007 | Vacek et al. | |
| 7,377,867 | B1 | 5/2008 | Vacek et al. | |
| 7,534,179 | B1 | 5/2009 | Vasek et al. | |
| 7,534,180 | B1 | 5/2009 | Vacek et al. | |
| 2001/0021678 | A1 * | 9/2001 | Pitsenberger et al. | 473/564 |
| 2004/0166970 | A1 * | 8/2004 | Sutherland | 473/567 |
| 2004/0198539 | A1 * | 10/2004 | Sutherland et al. | 473/567 |
| 2010/0160095 | A1 * | 6/2010 | Chauvin et al. | 473/564 |
| 2010/0311525 | A1 * | 12/2010 | Cornford et al. | 473/457 |

* cited by examiner

*Primary Examiner* — Mark Graham
(74) *Attorney, Agent, or Firm* — Welsh Flaxman & Gitler LLC

(57) ABSTRACT

A non-wood baseball or softball bat wherein the barrel portion of the bat is filled with an inner foam layer which has a relatively low compressibility surrounded by an outer foam layer having high compressibility. This configuration would not hinder the hitting performance of less skilled players in an effort to control the maximum rebound speed generated by the best players.

8 Claims, 5 Drawing Sheets

BASEBALL BAT EMPLOYING A DUAL DENSITY FOAM MATERIAL

FIELD OF THE INVENTION

The present invention is generally related to the field of baseball and softball and more specifically to a baseball or softball bat.

BACKGROUND OF THE INVENTION

Baseball and softball players continually search for better bats to improve their hitting performance. Bat performance is generally based upon length, weight, moment of inertia (MOI) and impact response during contact with the ball. Manufacturers have made attempts to improve the impact response during contact with the ball using a variety of material construction. Unfortunately, each of these prior attempts has various shortcomings.

As manufacturers have improved bats, various regulatory bodies and administrators of organized baseball and softball games have placed restrictions on bat performance and configuration. In order to limit the maximum response to the bat, manufacturers have traditionally modified their designs to dampen the response to all impacts. In other words, these designs reduce the responsiveness of the bat at both low impact speeds as well as high impact speeds. Typically this is done by adding material to the thickness of the barrel portion of the bat to increase the hoop of stiffness. This approach hinders the hitting performance of less skilled players in an effort to control the maximum rebound speed generated by the best players.

Bat rebound performance is generally maximized at a narrow width of the barrel commonly referred to as the sweet spot. The prior art includes several attempts to produce a bat with reduced performance at the sweet spot. The intent of these designs has been to level the impact response along the width of the barrel, effectively widening the perceived sweet spot. These attempts have several shortfalls. For example, U.S. Pat. No. 6,949,038, issued to Fritzke, discloses increasing in the wall thickness of the bat near the sweet spot. This is accomplished, for example, by including an insert 22, as illustrated in FIG. 4, having first and second tubular wall transition regions 36 and 38, as well as an intermediate tubular region 40, having an increased thickness. Additionally, as illustrated with respect to FIG. 7, an intermediate tubular region 140 provided on the outside surface of the bat would also have an increased thickness. As can be appreciated, the added thickness of the insert or the outer portion of the bat would add additional weight and create stress concentrations at each end of the thicker regions.

Consequently, there is a need to provide an improved bat which would meet regulation standards for maximum barrel response with less dampening at slower speed impacts.

Additionally, there is a need to produce a bat having a more consistent impact response along the length of the barrel than conventional bats without the increased weight or the creation of stress concentrations, as described in prior art references.

Baseball bats are generally constructed having a barrel portion, a tapered portion and a handle portion. Recently, several U.S. patents have illustrated non-wood bats provided with a foam in the interior of the bat filling at least a portion of the barrel as well as perhaps a portion of the tapered portion. For example, U.S. Pat. Nos. 6,248,032, 6,334,824 and 6,432,007, issued to Filice et al describe an aluminum shell bat including a foam filler 30 comprising a syntactic foam which substantially fills the interior of the bat shell 10 in the hitting area by filling the entire barrel of the bat as well as a portion of the tapered area. It is important to note that the foam filler 30 consists of only a single density material.

U.S. Pat. Nos. 5,458,330 and 5,533,723 both issued to Baum describe a composite baseball bat provided with a core in the barrel section. This baseball bat includes a layer of wood-like veneer covering a layer of fiber reinforced resin. FIGS. 12 and 13 illustrate a bat having a core with a central cavity. As discussed in column 4, lines 18-30 of both patents, a core 28 is provided formed from a resilient urethane foam. It is noted that this core 28 extends around a plug 31 in the barrel portion of the bat as well as extending throughout the handle portion. As further described in column 5, lines 20-51 of the '723 patent, the plug 31 is provided within the central cavity formed of a different and generally less dense material than the core 28. Since the plug material 31 is less dense than the material of the core, the plug 31 would be more compressible than the core 28.

U.S. Pat. No. 3,810,098 issued to Gildemeister discusses a metallic baseball bat including a hollow tube having a rigid urethane foam core 20 as well as a plug 15*a* comprised of a heavier foam than the core 20. It is noted that the plug 15*a* does not surround the rigid urethane foam but is provided adjacent to the end cap portion of the bat.

U.S. Pat. No. 5,964,673 issued to MacKay, Jr. describes a hollow metallic bat containing one or more resilient sponge-like balls 26. A hardenable material 28, such as urethane or the like is provided around a portion of one of the balls as shown in FIG. 4 or would completely surround a sponge ball as illustrated with respect to FIG. 5.

However, it has been found that the aforementioned designs would produce a bat in which the hitting performance of the less skilled players might be compromised in the effort to control the maximum rebound speed generated by the best players.

Consequently, a need has arisen in which the placement and type of foam materials particularly within the barrel portion of the bat would be crucial to elevating the performance of lesser players without hindering the performance of the better players.

SUMMARY OF THE INVENTION

The deficiencies of the prior art are addressed by the present invention in which a non-wood baseball or softball bat is produced utilizing an insert with a highly compressible outer foam layer which allows the bat frame to deflect within a limited range with minimal dampening of the vibrations produced when a ball strikes the outer surface of the baseball or softball bat. The prior art use of a single density material such as described in the aforementioned Felice patents would dampen even small deflections of the baseball bat frame. The present invention would allow a greater barrel response (commonly referred to as the "trampoline effect") for lower speed impacts verses the prior art, while still limiting the maximum barrel response for higher speed impacts produced by the best players. This would allow the bat to meet the required safety standards by the various governing bodies, but still providing an improved hit performance for the less skilled players.

Additionally, the present invention is also an improvement of the prior art bats utilizing a dual density material such as described in the aforementioned Baum patents. As previously indicated, the Baum patents employ a core material formed from a resilient urethane foam which is denser and therefore less compressible than the plug material which it surrounds. This is in contradistinction to the present invention utilizing two separate foams of different density. A first foam material is provided in the interior of the bat extending from the end cap to approximately the beginning of the tapered portion of the bat. This material is surrounded by a thin layer of a foam material having a density less than the density of the inner foam material. Consequently, the thin outer layer of the foam is much more compressible than the inner foam layer. This particular configuration would provide for a better performance at low impact speeds than the prior art bats utilizing a single foam material.

These and other objects of the present invention will be explained in detail with respect to the following detailed description, when viewed with respect to the accompanying drawings, wherein like reference numerals refer to like parts.

DETAILED DESCRIPTION OF THE PRESENT INVENTION

Figure 1:
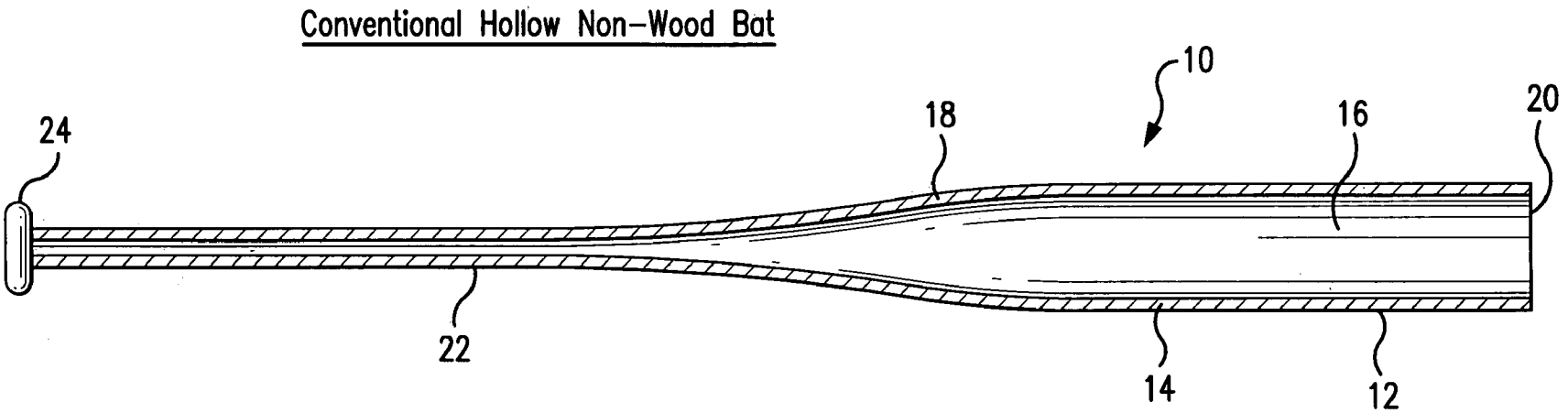
FIG.1 PRIOR ART
FIG. 1 is a longitudinal cross-sectional drawing of a conventional hollow non-wooden bat.

FIG. 1 illustrates a typical hollow non-wood bat 10 generally consisting of a barrel portion 12 provided with an outer surface 14 which includes the primary hitting portion of the bat normally known as the sweet spot. The material of the outer surface 14 would be metallic, such as aluminum or titanium. Alternatively, the exterior surface of the bat can be constructed from a composite fiber material. A handle 22 is used by the player to properly grip the bat. A tapered portion 18 is provided between the barrel portion 12 and the handle 22. The interior portion of the bat 16 is generally hollow and would extend from an end cap 20 through the barrel portion 12 to the tapered portion 18 and then to the handle portion 22.

Figure 2:
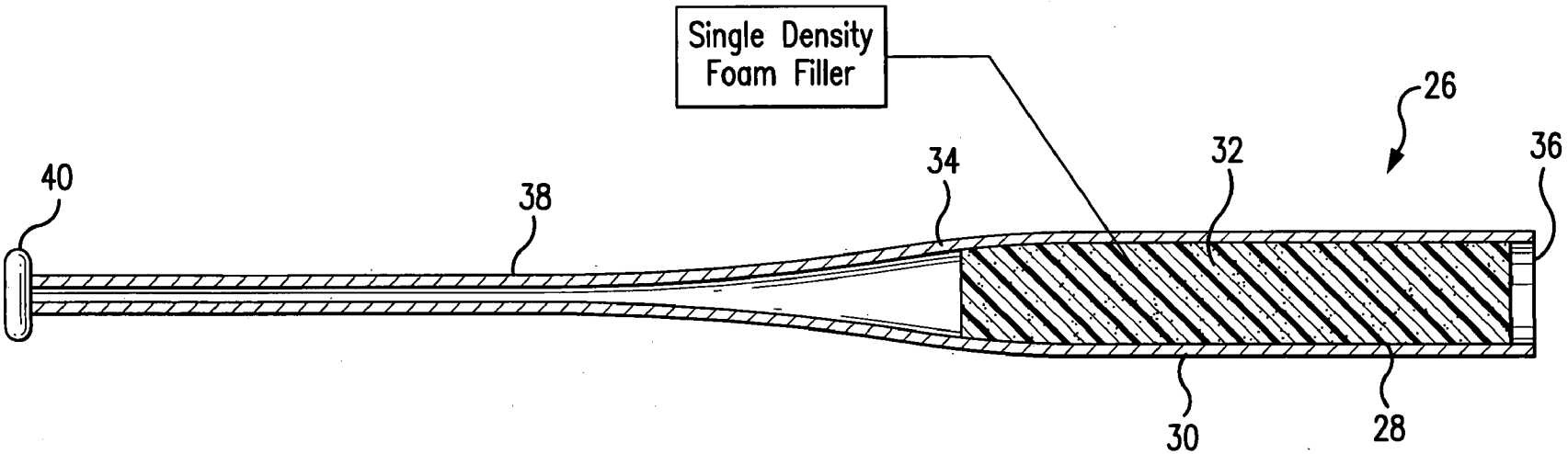
FIG.2 PRIOR ART
FIG. 2 is a longitudinal cross-sectional drawing of a prior art bat having a single density foam filler.

The prior art, such as discussed in the Filice patents would try to minimize impact induced vibrations by filling a portion of the interior of the bat with a single density foam material. As shown in FIG. 2, the prior art bat 26 is provided with an outer surface 30 and would also include a barrel section 28, an end cap 36, a tapered portion 34, a handle 38 and an end knob 40. The entire barrel portion of the bat 28 and possibly a small portion of the tapered section 34 abutting the barrel 28 would be filled with a single density foam material 32. The foam would have a density and hardness correlated with the thickness of the bat wall in the hitting area.

Figure 3:
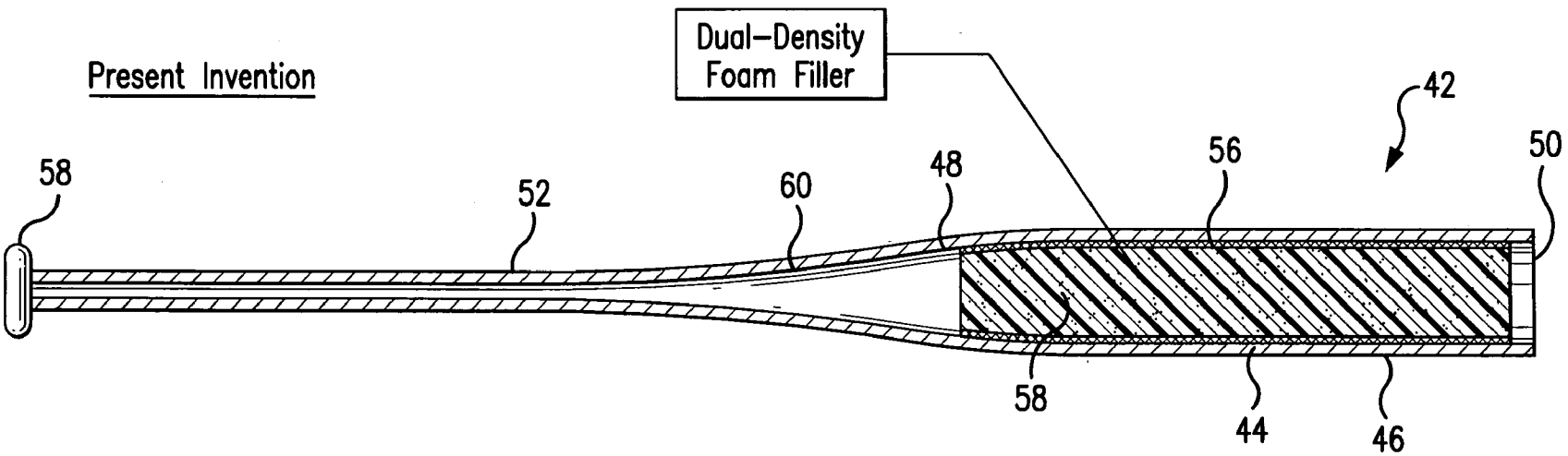
FIG. 3 is a longitudinal cross-sectional drawing of a first embodiment of the present invention.
Figure 4:
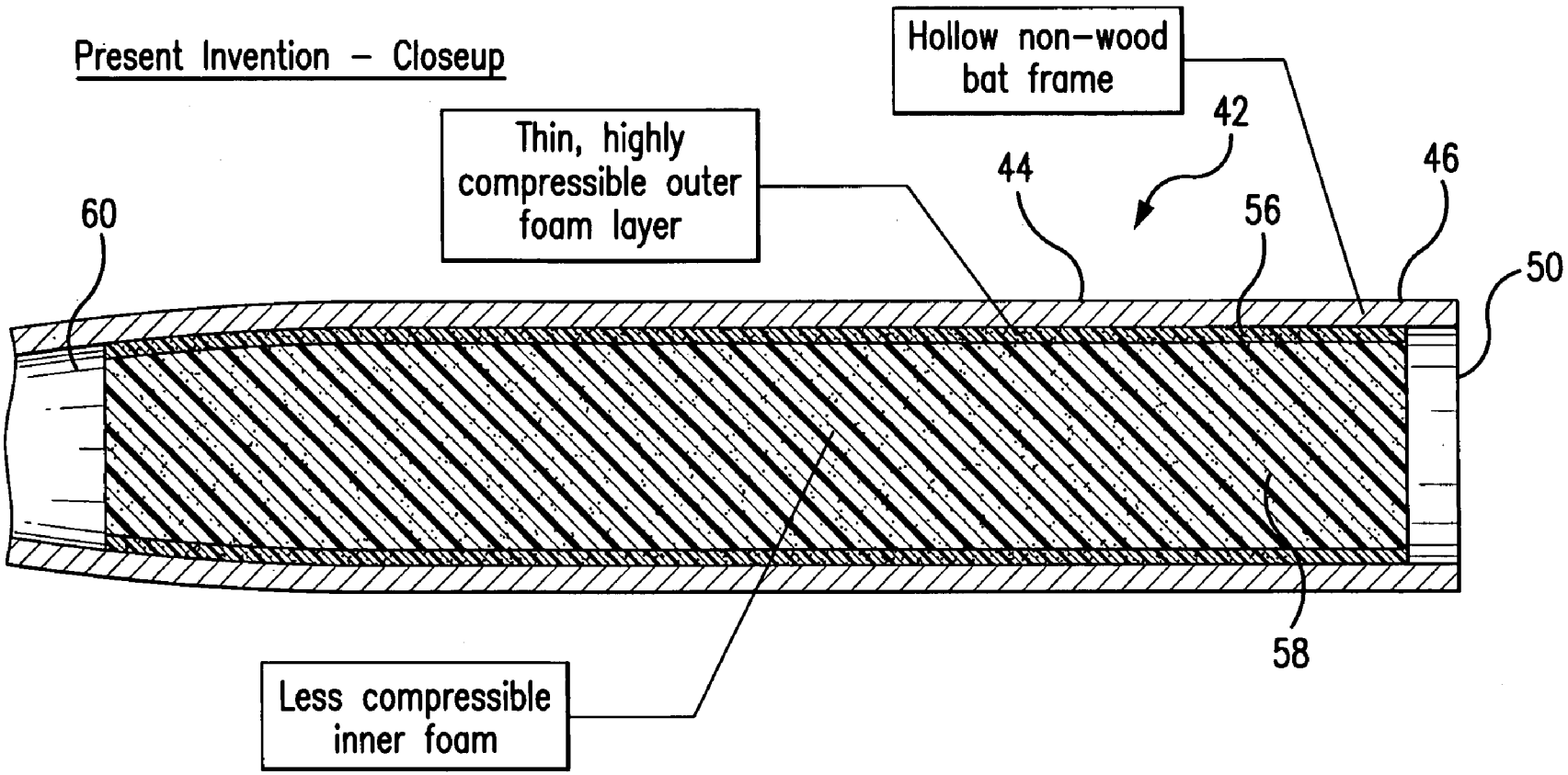
FIG. 4 is an enlarged cross-sectional drawing of the embodiment shown in FIG. 3.

FIGS. 3 and 4 illustrate a first embodiment of the present invention. These figures show a non-wood bat 42 including a barrel section 44 provided with an outer surface 46, an end cap 50, a handle 52 and a tapered section 48 extending between the barrel 44 and the handle 52. Similar to prior art bats, an end knob 54 would be provided at the end of the handle section 52. The entire interior section of the barrel 44 would be filled with two different types of foam material. The majority of the interior section of the barrel 44 would be filled with a relatively low compression inner foam material 58. The tapered portion 48 and the handle portion 52 are not filled with the foam material and remain hollow for their entire length as shown by 60.

This inner foam material 58 would be surrounded by a thin highly compressible outer foam layer 56. The outer highly compressible foam layer 56 could be constructed from an open cell polyether or polyester foam having a compressive deflection of less than one psi to compress 25% of the volume of that outer foam layer 56. The inner foam layer 58 is much less compressible than the outer foam layer 56. This foam layer 58 can be constructed from an expanded polystyrene foam (EPS foam) or a closed cell polyethylene. The compressive deflection of the inner foam layer would be greater than 10 psi to compress 25% of the volume of this inner foam layer. The inner foam layer 58 would constitute approximately 85% to 95% of the inner volume of the barrel 44, with the outer foam layer 56 constituting approximately 5% to 15% of inner volume of the barrel 44.

Figure 5:
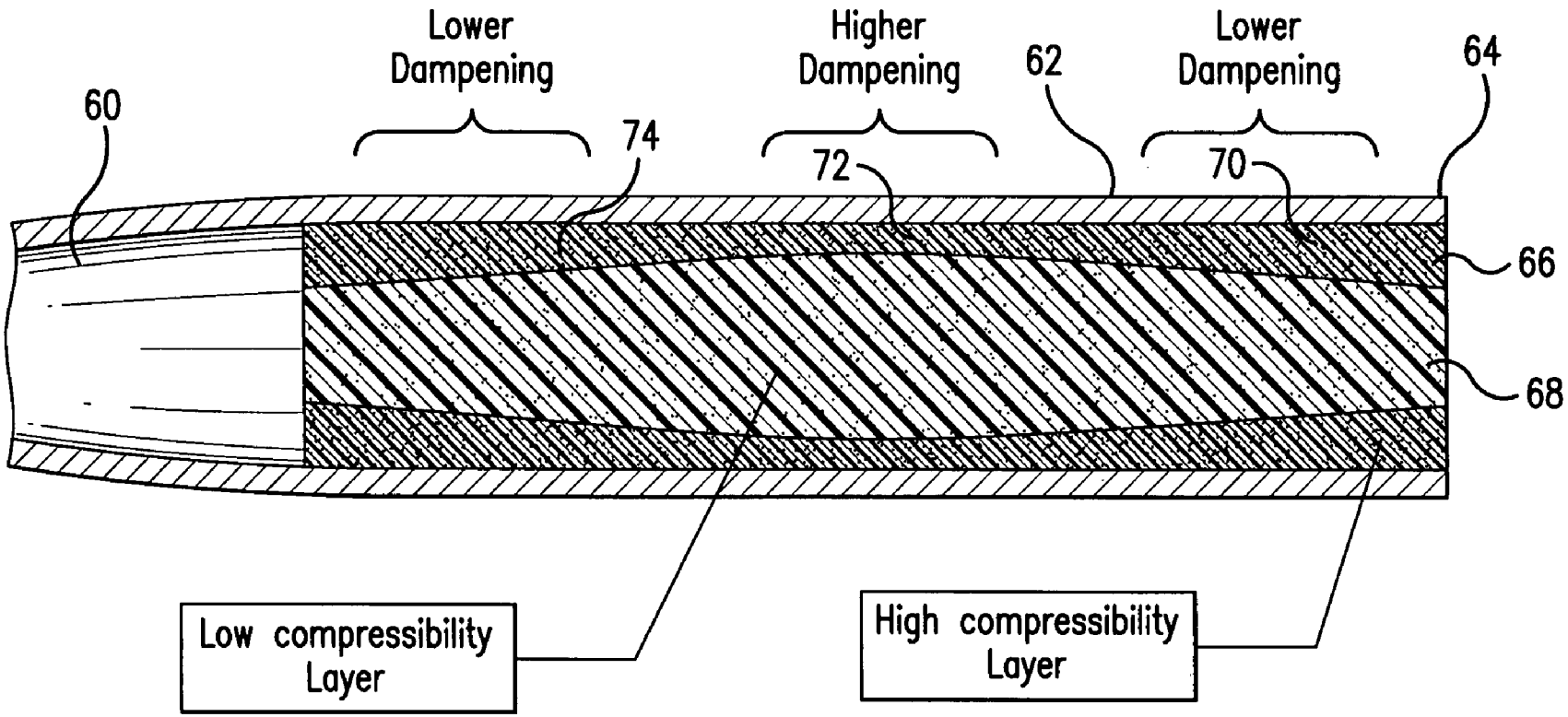
FIG. 5 is a longitudinal cross-sectional drawing of a second embodiment of the present invention.

FIG. 5 illustrates a second embodiment of the present invention which primarily illustrates the barrel portion 62 having an outer surface 64 of the bats illustrated with respect to FIGS. 3 and 4. Similar to FIGS. 3 and 4, the portion of the bat illustrated with respect to FIG. 5 would include a relatively low compressibility foam layer 68 surrounded by a relatively high compressibility layer 66. However, as illustrated with respect to FIGS. 3 and 4, the thickness of the outer foam layer 58 and the outer foam layer 56 is constant over the length of the barrel 44. This is to be distinguished from the barrel 62 in which the thickness of the outer foam portion 66 and the inner foam portion 68 would gradually vary over the length of the barrel 62. For example, the thickness of the outer foam layer 66 is smallest at approximately the middle portion of the bat 72. The diameter of the outer foam layer 66 would gradually increase as it moves from the section 72 to section 70 as it approaches the end cap of the barrel as well as gradually increase as it approaches the tapered section of the bat at 74. Since the inner foam layer 68 as well as the outer foam layer 66 fill the entire interior of volume of the barrel 62, as the thickness of the outer foam layer 66 increases, the diameter of the inner foam layer 68 would decrease and vice versa. Similar to the embodiments illustrated with respect to FIGS. 3 and 4, the outer foam layer 66 is highly compressible whereas the inner foam layer 68 has a lower compression ratio. This would result in a higher damping and therefore less vibration created in section 72 with lower damping and therefore higher vibrations created in sections 70 and 74.

The volume of both the inner and outer foam layers varies through the length of the barrel. For example, the volume of both of the foam layers would be approximately equal to one another close to the end cap as well as close to and end of the tapered portion. The ratio of the volume of the inner and outer layers would change as the inner and outer layer approach section 72 from both ends. For example, the volume of the inner layer 68 at section 72 would be approximately 90-95% of the entire inner volume of the barrel, and the volume of the outer layer would be approximately 5-10%.

The higher and lower density foam layers would be inserted into the interior of the barrel portion of the bat during the typical assembly process.

It is appreciated that various features of the present invention which are, for clarity, described in the context of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims as follows:

What is claimed is:

1. A non-wood baseball or softball bat comprising:

a barrel section;

a tapered section abutting said barrel section;

a handle section abutting said tapered section;

the interior of said barrel section filled with a first layer of foam material and a second layer of foam material surroundings said first layer of foam material, said second layer of foam material having a greater compressibility than said first layer of foam material, wherein the first and second layers of foam material entirely fill an interior of said barrel section and a thickness of both the first layer of foam material and the second layer of foam material vary in thickness along the length of said barrel section.

2. The baseball or softball bat in accordance with claim 1, wherein the compressive deflection of said first layer of foam material is >10 psi at 25% volume and the compressive deflection of said second layer of foam material is <1 psi at 25%.

3. The baseball or softball bat in accordance with claim 1, wherein said first layer of foam material is constructed from polystyrene or polyethylene and said second layer of foam is constructed from polyether or polyester.

4. The baseball or softball bat in accordance with claim 2, wherein said first layer of foam material is constructed from polystyrene or polyethylene and said second layer of foam is constructed from poly ether or polyester.

5. The baseball or softball bat in accordance with claim 1, wherein the thickness of said first layer of foam material is greatest in the middle of said barrel section and least at both ends of said barrel section, and further wherein the thickness of said second layer of foam material is least at the middle of said barrel section and greatest at both ends of said barrel section.

6. The baseball or softball bat in accordance with claim 1, wherein an exterior surface of the bat is constructed from metallic material.

7. The baseball or softball bat in accordance with claim 6, wherein said metallic material is aluminum or titanium.

8. The baseball or softball bat in accordance with claim 1, wherein an exterior surface of the bat is constructed from composite fiber material.

* * * * *